US008806831B1

(12) United States Patent
Dreyer

(10) Patent No.: US 8,806,831 B1
(45) Date of Patent: Aug. 19, 2014

(54) INTERLOCKING FLOOR TILES

(76) Inventor: Steven Ivan Dreyer, Hollywood, FL (US)

( * ) Notice: Subject to any disclaimer, the term of this patent is extended or adjusted under 35 U.S.C. 154(b) by 887 days.

(21) Appl. No.: 12/804,125

(22) Filed: Jul. 14, 2010

Related U.S. Application Data

(60) Provisional application No. 61/339,882, filed on Mar. 10, 2010.

(51) Int. Cl.
*E04F 15/02* (2006.01)
*E04B 1/61* (2006.01)

(52) U.S. Cl.
USPC ..... 52/588.1; 52/177; 52/590.1

(58) Field of Classification Search
USPC ..... 52/177, 588.1, 590.1, 590.2, 590.3, 52/591.2, 592.4
See application file for complete search history.

(56) References Cited

U.S. PATENT DOCUMENTS

| | | | | | |
|---|---|---|---|---|---|
| 2,189,218 | A | | 2/1940 | Neumeister | |
| 3,657,852 | A | | 4/1972 | Worthington | |
| 5,787,654 | A | * | 8/1998 | Drost | 52/177 |
| 5,791,114 | A | | 8/1998 | Mandel | |
| 5,904,021 | A | * | 5/1999 | Fisher | 52/578 |
| 5,913,781 | A | * | 6/1999 | Vidmar et al. | 52/102 |
| 5,950,378 | A | * | 9/1999 | Council et al. | 52/177 |
| 5,992,106 | A | * | 11/1999 | Carling et al. | 52/177 |
| 6,089,784 | A | * | 7/2000 | Ardern | 404/41 |
| 6,098,354 | A | * | 8/2000 | Skandis | 52/177 |
| 6,682,254 | B1 | * | 1/2004 | Olofsson et al. | 403/375 |
| 6,751,912 | B2 | * | 6/2004 | Stegner et al. | 52/177 |
| 6,769,219 | B2 | * | 8/2004 | Schwitte et al. | 52/592.1 |
| 6,802,159 | B1 | * | 10/2004 | Kotler | 52/177 |
| 6,820,386 | B2 | | 11/2004 | Kappeli | |
| 7,114,298 | B2 | * | 10/2006 | Kotler | 52/177 |
| 7,340,865 | B2 | * | 3/2008 | Vanderhoef | 52/177 |
| 7,458,191 | B2 | | 12/2008 | Stone | |
| 7,571,572 | B2 | * | 8/2009 | Moller, Jr. | 52/177 |
| 7,793,471 | B2 | * | 9/2010 | Hill | 52/177 |
| 8,006,460 | B2 | * | 8/2011 | Chen et al. | 52/592.1 |
| 8,037,648 | B2 | * | 10/2011 | Vanderhoef | 52/177 |
| 8,266,849 | B2 | * | 9/2012 | Bravo et al. | 52/177 |
| 2003/0131549 | A1 | * | 7/2003 | Kappeli et al. | 52/390 |
| 2004/0258869 | A1 | * | 12/2004 | Walker | 428/44 |
| 2006/0070314 | A1 | * | 4/2006 | Jenkins et al. | 52/177 |
| 2007/0044412 | A1 | * | 3/2007 | Forster et al. | 52/592.1 |

FOREIGN PATENT DOCUMENTS

| | | | | |
|---|---|---|---|---|
| EP | 1304427 | A2 * | 4/2003 | E04F 15/04 |

* cited by examiner

*Primary Examiner* — Charles A. Fox
*Assistant Examiner* — Joseph J Sadlon
(74) *Attorney, Agent, or Firm* — Alvin S. Blum

(57) ABSTRACT

A floor tile has a rectangular, wear resistant, decorated upper portion. A rectangular lower portion is affixed to the upper portion. The lower portion has laterally projecting tongues extending outwardly from two adjacent sides. The other two adjacent sides have inwardly directed pockets adapted to receive the tongues of adjacent tiles to form a continuous floor covering. Only the edges of the tongues and pockets that resist movement of adjacent tiles away from one another are close fitting to facilitate installation.

4 Claims, 7 Drawing Sheets

INTERLOCKING FLOOR TILES

This application claims the benefit of provisional application for patent Ser. No. 61/339,882 filed Mar. 10, 2010, incorporated herein by reference in its entirety.

FIELD OF THE INVENTION

This invention relates generally to floor tiles with a decorative top that emulate ceramic or stone tiles or wood planks, and more particularly to floor tiles that interconnect to lock together without adhesives to form a floating floor covering.

BACKGROUND OF THE INVENTION

U.S. Pat. No. 6,820,386 issued Nov. 23, 2004 to Kappeli and U.S. Pat. No. 3,657,852 issued Apr. 25, 1972 to Worthington review the prior art on floor tiles having locking mechanisms consisting of tongues that interlock with pockets underneath the visible surface portion. They both teach forming a continuous floor covering that is not adherent to the substrate floor. Their objective of providing a floating floor covering that will not be disrupted by movement of the underlying floor is achieved. Fitting the pockets over the closely fitting tongues during installation is difficult, because the process is obscured by the overlying visible portion. This greatly increases the installation problems and costs. U.S. Pat. No. 5,791,114 issued Aug. 11, 1998 to Mandel teaches the tongue and pocket interlocking method of forming a floor covering. It makes the interlocking mechanism visible by having the tongues and pockets extend all the way through the tile, including the top portion. However, because the joints are visible, they must be very tight. This makes the installation process difficult, because it takes excessive time and effort to fit each tongue into its corresponding pocket.

SUMMARY OF THE INVENTION

It is accordingly an object of the invention to provide floor tiles that lock together without adhesives to form a floating floor covering. The term "floor tile" is intended to include, but not limited to, floor tiles and floor planks that are laminated rubber and plastic in various compositions. Each tile has an upper portion that is rectangular in shape and dimensioned to fit against adjacent tiles to form a smooth traffic surface with no more than optional minimal groove at their interfaces to emulate a grout line. Said rectangular shape includes, but is not limited to, equilateral rectangles, i.e. square, as well as elongate rectangles, i.e. plank, tiles. A rectangular lower portion of each tile has two adjacent straight sides that have tongues that extend outwardly from their sides. The other two adjacent straight sides have tongue receiving pockets within their sides to each receive a tongue of an adjacent tile. The tongues and pockets are positioned relative to the upper portions to ensure close approximation of the upper portions to one another. The pockets are positioned under the top portion, and the tongues extend beyond the top portion. The tongues and pockets are constructed to facilitate insertion of the tongues within the pockets. The ease of insertion is achieved by limiting close fitting of the tongue into the pocket of only those edges that ensure holding the adjacent tiles together. All other edges are loose fitting so that they do not resist the fitting of the tongue in the pocket. Because each of the four sides of the tile is held securely to an adjacent tile, the edges of the tongue not held tightly in the pocket do not compromise the secure connection of the tiles to one another. The shape of the tiles may be large blocks to emulate ceramic or stone tiles with the upper surface displaying a corresponding pattern. Alternatively, the surface may emulate wood grain, and the shape may emulate long wooden planks. The surface is constructed to resist wear.

These and other objects, features, and advantages of the invention will become more apparent from the detailed description of exemplary embodiments thereof as illustrated in the accompanying drawings, in which like elements are designated by like reference characters in the various drawing figures.

DETAILED DESCRIPTION OF PREFERRED EMBODIMENTS

Figure 1:
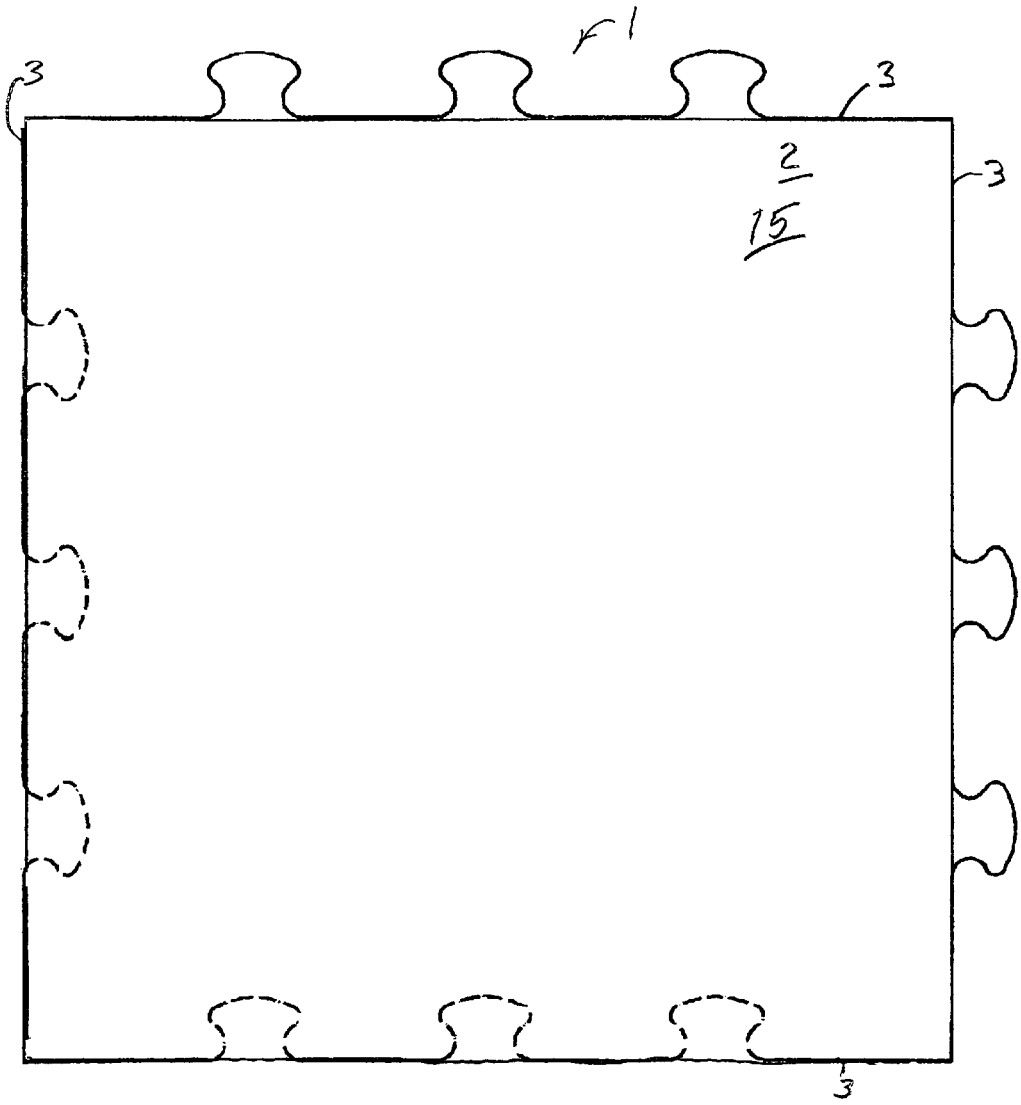
FIG. 1 is a top view of a tile of the invention
Figure 2:
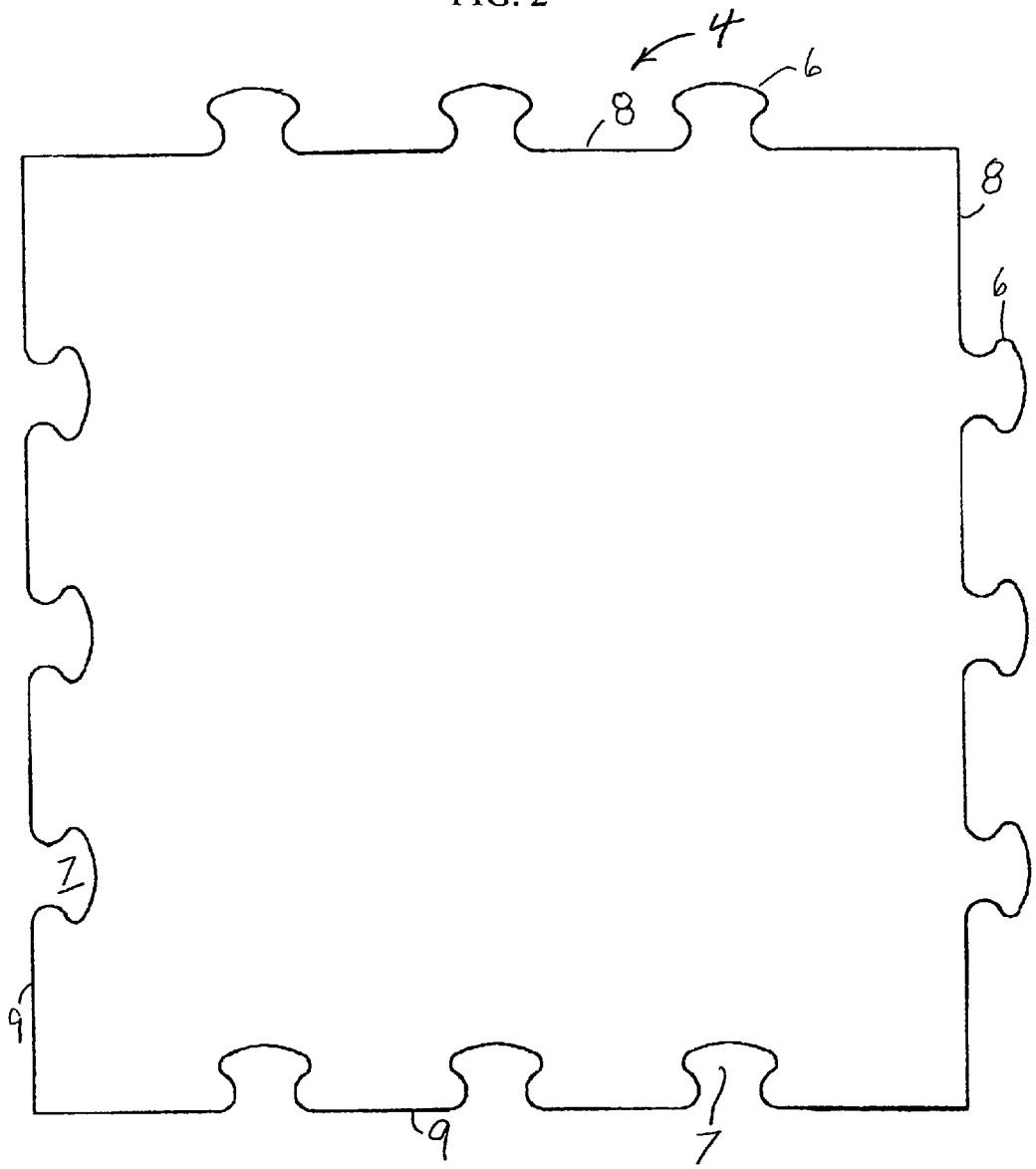
FIG. 2 is a top view of the lower portion of the tile
Figure 3:
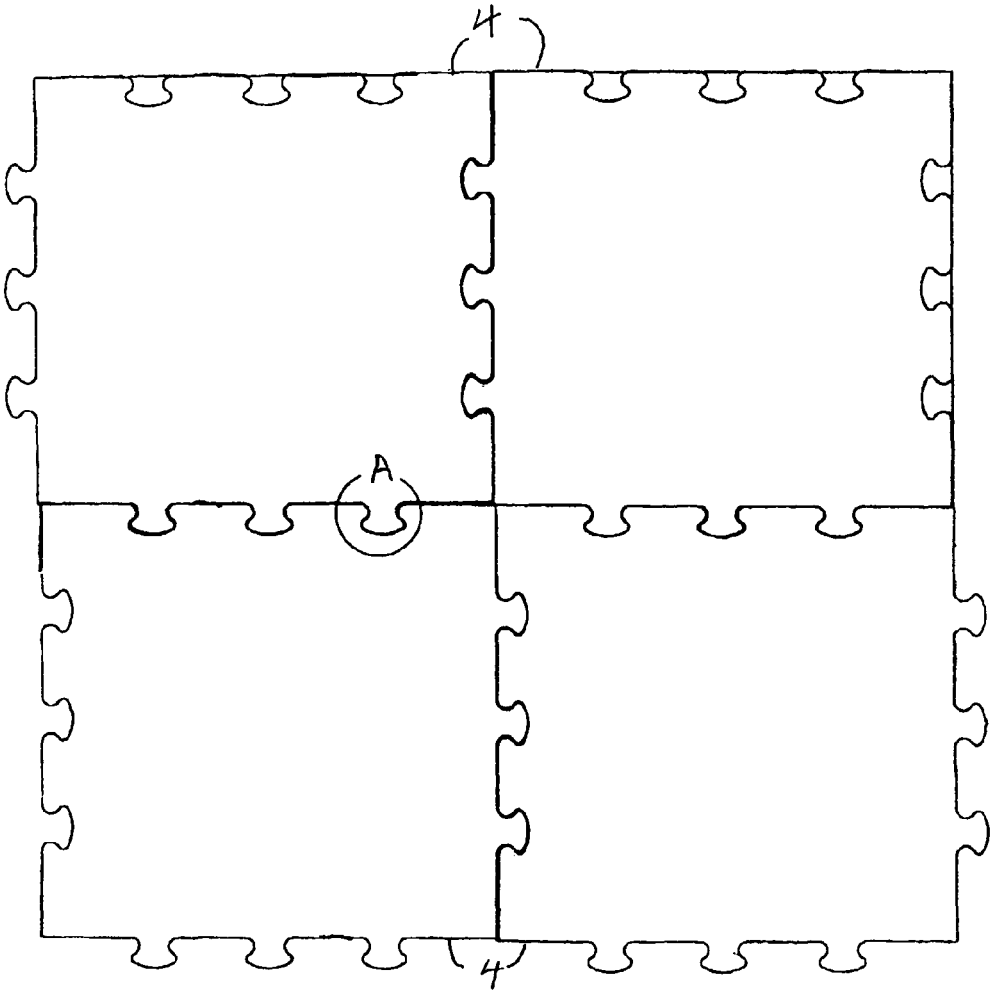
FIG. 3 is a bottom view of the tiles in interlocked condition.
Figure 4:
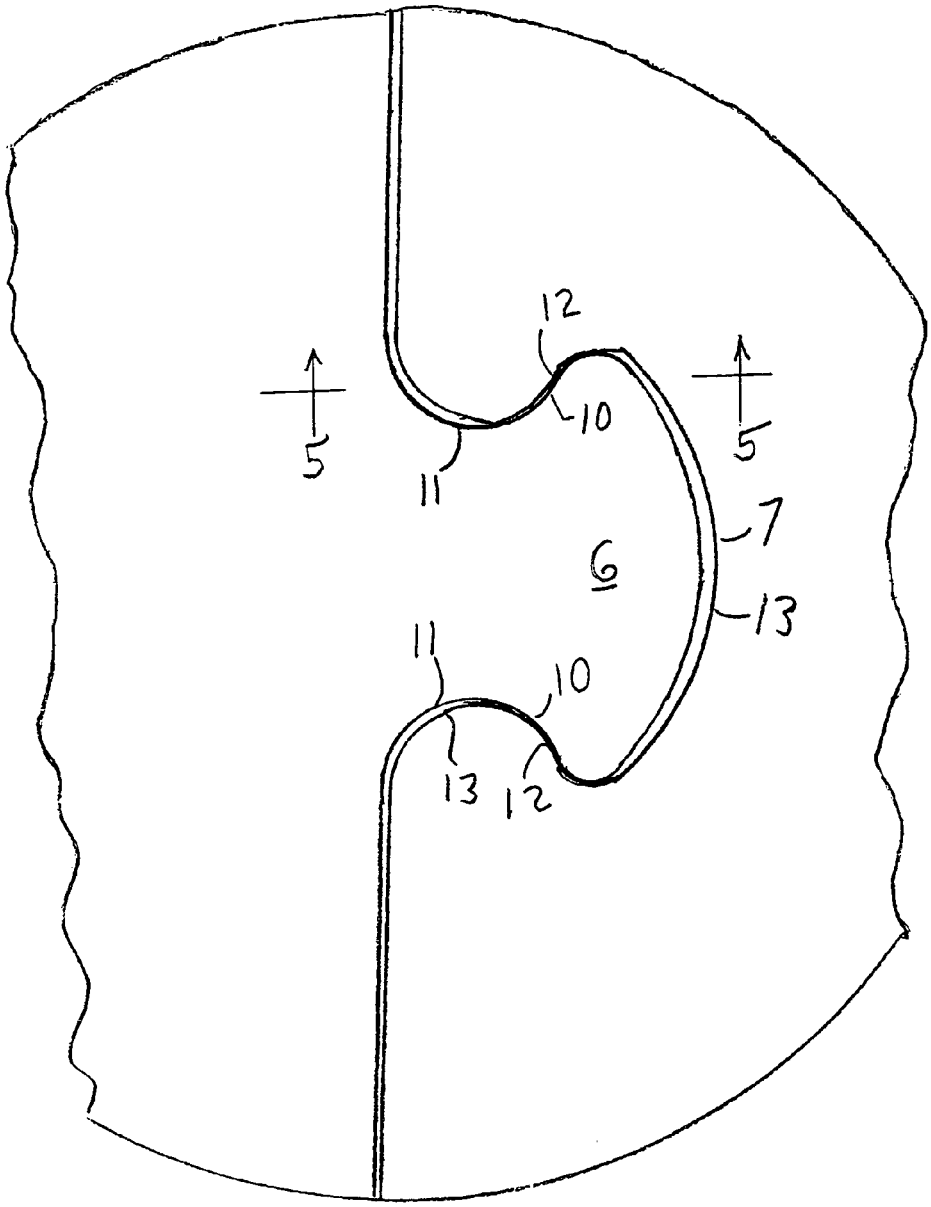
FIG. 4 is a detailed view of the portion A of FIG. 3.
Figure 5:
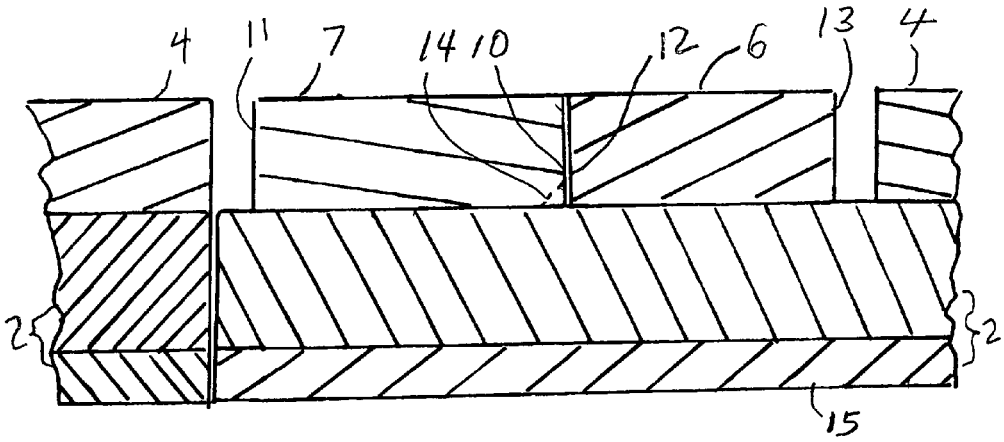
FIG. 5 is a sectional view through line 5-5 of FIG. 4.

Referring now first to the drawing FIGS. 1-5, floor tiles 1 of the invention have a rectangular upper portion 2 that is provided with a wear resistant decorative upper surface 15 that may give the appearance, for example, but not limited to, ceramic or stone. The straight sides 3 of the upper portion may have lengths dictated by esthetic or pragmatic considerations. The straight sides 3 are constructed to fit against the sides of adjacent tiles to form a smooth traffic surface with no more than optional minimal groove at their interface to emulate a grout line. A rectangular lower portion 4 is affixed to the upper portion 2. Tongues 6 extend outwardly from two adjacent straight sides 8 of the lower portion. Pockets 7 extend inwardly from the other two adjacent straight sides 9 under the upper portion.

The tongues and pockets are constructed so that the pockets 7 fit onto the tongues 6 of adjacent tiles, when the upper portion is positioned closely against adjacent tiles; and the edges 12 of the pockets fit closely against the edges 10 of the tongues that prevent movement of adjacent tiles away from each other. The other edges 13 of the pockets do not touch the edges 11 of the tongues so that their loose fitting facilitates installation. To further facilitate installation, a close fitting edge 10 or 12 of either the tongue or the pocket may optionally have the bevel 14 (shown in phantom).

Figure 9:
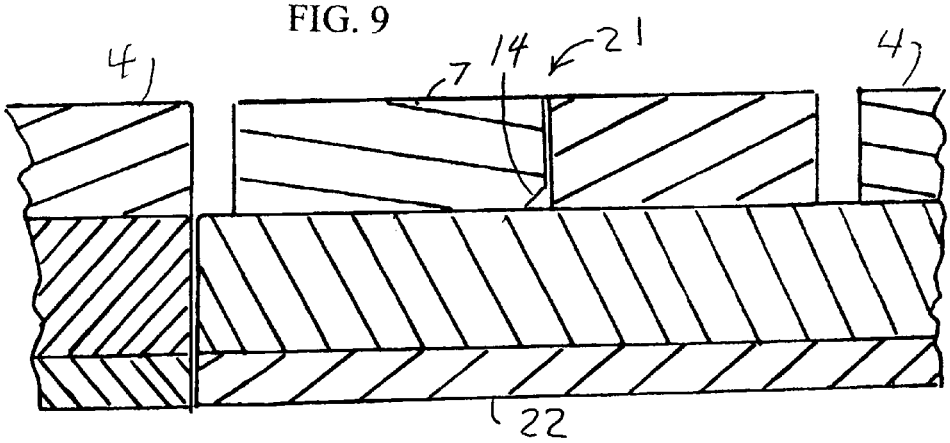
FIG. 9 is a sectional view through line 9-9 of FIG. 8.
Figure 6:
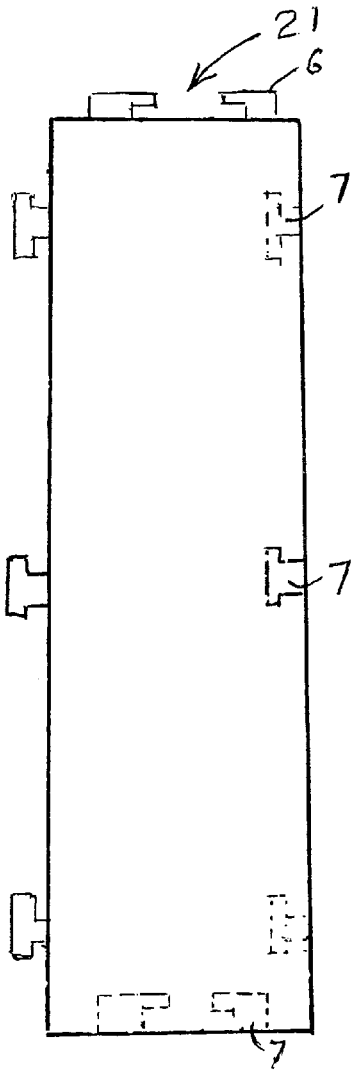
FIG. 6 is a top view of another embodiment of the invention.
Figure 7:
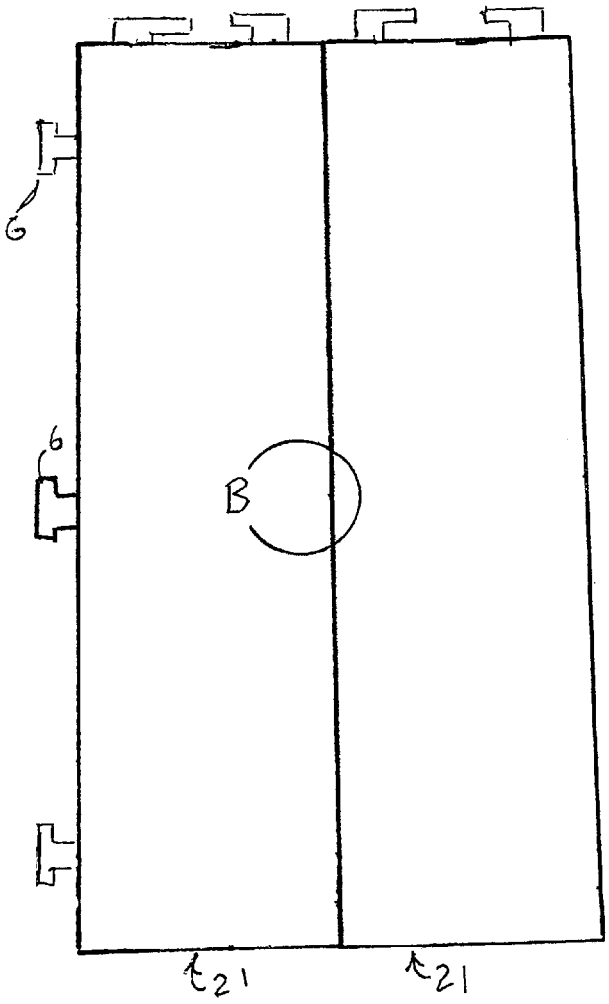
FIG. 7 is a top view of two tiles of FIG. 6 locked together.
Figure 8:
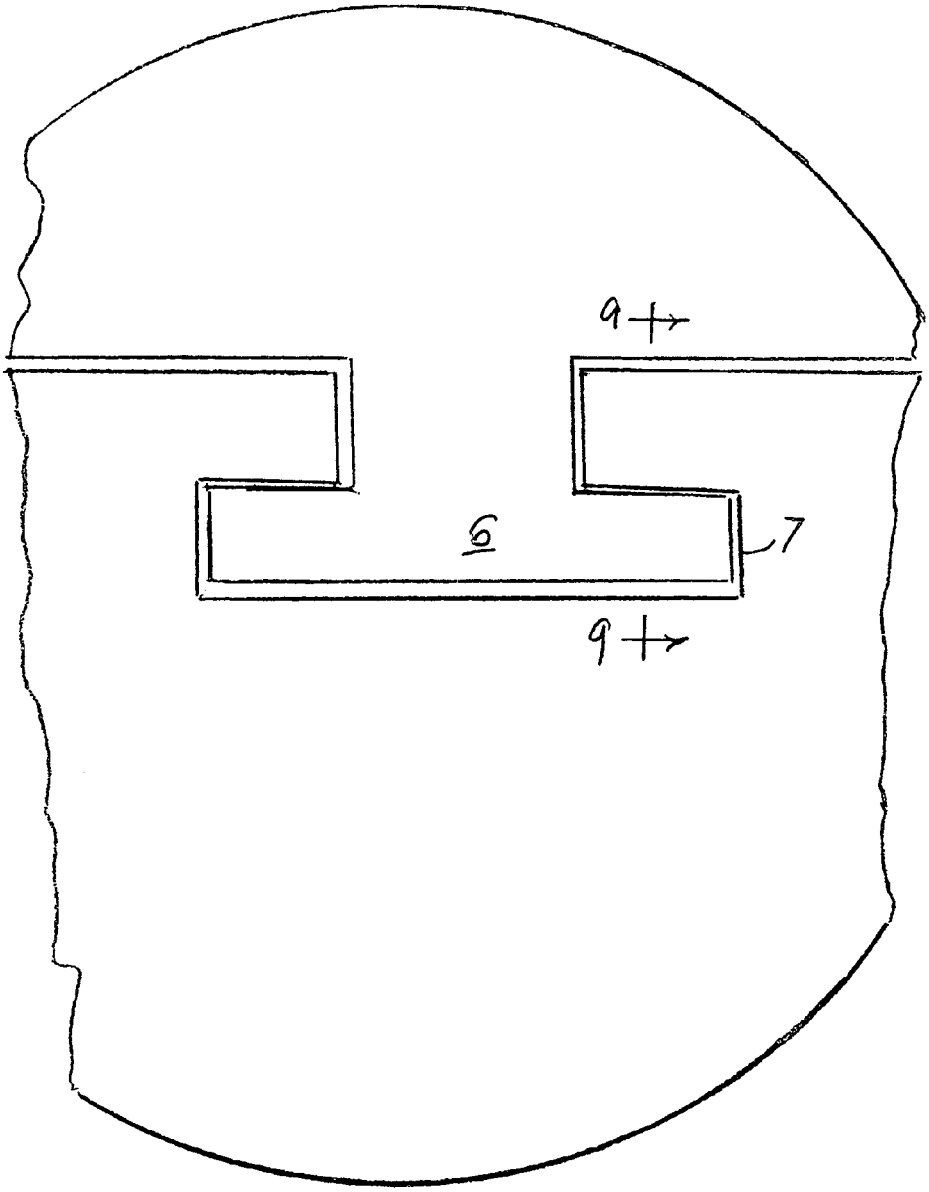
FIG. 8 is a detailed bottom view of area B of FIG. 7.

Referring now to FIGS. 6-9, a floor tile 21 of the invention is an elongate rectangle 21 having a wear resistant upper surface 22 decorated to emulate, for example, but not limited to, wood flooring boards. It is provided with tongues 6 and pockets 7 as described above.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. An interlocking floor tile comprising:

a rectangular upper portion having a decorative wear-resistant upper traffic surface and straight sides dimensioned to fit closely against straight sides of adjacent tiles with minimal space therebetween;

a rectangular lower portion affixed to the upper portion, the lower portion having straight sides;

a plurality of spaced-apart tongues extending outwardly from a first two adjacent straight sides of the lower portion;

a plurality of spaced-apart pockets extending inwardly from a second two adjacent straight sides of the lower portion opposite the first two adjacent straight sides of the lower portion;

the tongues and pockets so constructed that the pockets fit onto the tongues of adjacent tiles, when the upper portion is positioned closely against adjacent tiles; and edges of the pocket and tongue that prevent movement of adjacent tiles away from each other being close fitting and other edges of the pocket and tongue being loose fitting to facilitate installation.

2. The interlocking floor tile according to claim 1 in which one of the close fitting edges is provided with a bevel to facilitate installation.

3. An interlocking floor tile comprising:

a rectangular upper portion having a decorative wear-resistant upper traffic surface and straight sides dimensioned to fit closely against straight sides of adjacent tiles with minimal space therebetween;

a rectangular lower portion having straight sides;

a plurality of spaced-apart tongues extending outwardly from a first two adjacent straight sides of the lower portion;

a plurality of spaced-apart pockets extending inwardly from a second two adjacent straight sides of the lower portion opposite the first two adjacent straight sides;

the lower portion affixed to the upper portion so that the pockets are beneath the upper portion and the tongues extend outwardly from beneath the upper portion;

the tongues and pockets so constructed that the pockets fit onto the tongues of adjacent tiles, when the upper portion is positioned closely against adjacent tiles; and edges of the pocket and tongue that prevent movement of adjacent tiles away from each other being close fitting and other edges of the pocket and tongue being loose fitting to facilitate installation.

4. The interlocking floor tile according to claim 3 in which at least one of the close fitting edges is provided with a bevel to facilitate installation.

* * * * *